US010329670B2

(12) United States Patent
Maev et al.

(10) Patent No.: US 10,329,670 B2
(45) Date of Patent: Jun. 25, 2019

(54) APPARATUS AND METHOD FOR COLD SPRAYING AND COATING PROCESSING

(71) Applicant: Tessonics, Inc., Windsor (CA)

(72) Inventors: Roman Gr. Maev, Windsor (CA); Volf Leshchynsky, Windsor (CA); Emil Strumban, West Bloomfield, MI (US); Damir Ziganshin, Windsor (CA); Raymond Belenkov, Windsor (CA); Dmitry Dzhurinskiy, Windsor (CA)

(73) Assignee: Tessonics, Inc. (CA)

( * ) Notice: Subject to any disclaimer, the term of this patent is extended or adjusted under 35 U.S.C. 154(b) by 18 days.

(21) Appl. No.: 15/343,803

(22) Filed: Nov. 4, 2016

(65) Prior Publication Data

US 2017/0121825 A1 May 4, 2017

Related U.S. Application Data

(60) Provisional application No. 62/250,548, filed on Nov. 4, 2015.

(51) Int. Cl.
*C23C 24/04* (2006.01)

(52) U.S. Cl.
CPC ..... *C23C 24/04* (2013.01)

(58) Field of Classification Search
None
See application file for complete search history.

(56) References Cited

U.S. PATENT DOCUMENTS

2006/0090593 A1* 5/2006 Liu ..... B22F 1/0048 75/252

FOREIGN PATENT DOCUMENTS

WO WO-2015061164 A1 * 4/2015 ..... C23C 24/04

OTHER PUBLICATIONS

International Search Report and Written Opinion of PCT/IB2016/056660 dated Feb. 1, 2017.

* cited by examiner

*Primary Examiner* — Michael P. Rodriguez
(74) *Attorney, Agent, or Firm* — Miller Canfield

(57) ABSTRACT

A nozzle element for applying powder material to a substrate is provided. The powdered material is applied from the nozzle element onto the substrate generating a coating of the powder material defined by a first film thickness and a first particle size of the powder material. A deformation nozzle element is provided for spraying shot toward the coating of powder material disposed upon the substrate deforming particles of the powder material disposed in the coating forming a second particle size being smaller than the first particle size and deforming the coating to define a second film thickness being less than the first film thickness.

14 Claims, 1 Drawing Sheet

APPARATUS AND METHOD FOR COLD SPRAYING AND COATING PROCESSING

PRIOR APPLICATIONS

The present application claims priority to U.S. Provisional Patent Application No. 62/250,548 filed on Nov. 4, 2015, the contents of which are incorporated herein by reference.

TECHNICAL FIELD

The present application relates toward a cold spraying coating system and method used to apply a protective coating to a substrate. More specifically, the present application relates toward an improved method of cold spraying a coating onto a substrate using spray shot to enhance performance of the coating.

BACKGROUND

Cold spraying particles onto a substrate surface to protect the substrate has been gaining increased acceptance as a viable method of coating a substrate. To obtain high-performance coatings the cold spraying is conducted at a high pressure with the assistance of a high-pressure gas, such as, for example, helium, nitrogen, and air having a coating material infused therein, which includes, for example, powder metals, refractory metals, alloys and composite materials. Powder particles having a size range of between about 20 to 50 micrometers are introduced at a high pressure into a supersonic gas stream generated by a spray gun and emitted from a nozzle. One such nozzle is disclosed in U.S. Pat. No. 8,132,740, the contents of which are incorporated herein by reference. The powder particles are accelerated to a supersonic velocity and directed to impact the substrate onto which the coating is to be formed.

Kinetic energy generated from impact of the particles on the substrate causes the particles to deform to a slightly flat configuration and diffuse into the substrate. The deformation promotes adhesion to the substrate, interlocking between adjacent particles and the substrate, and metallurgical bonding with the substrate resulting in a protective coating on the substrate. Because the particles are cold sprayed at near ambient temperatures, oxidation while airborne and forming the coating is prevented or significantly reduced.

However, because the distribution of the particles is not uniform and random, the structures of the coating and performance properties are not believed to be optimized. An effort to enhance the performance properties of the coating applied through conventional cold spraying includes a step of heat treatment or annealing of a cold spray coating in a furnace or by way of laser heating. However, heat treating or annealing the cold spray coatings is known to decrease the mechanical properties while resulting in more complexity and cost associated with cold spraying a substrate. Further, a laser heating process located adjacent the cold spraying operation is not viable due to airborne particles proximate the area of deposition and the inability to control necessary laser strength and other parameters to provide the desired annealing of the cold spray coating.

Coatings applied by high pressure cold spraying processes are believed provide desirable durability properties. However, it is difficult to perform high pressure cold spraying in a conventional industrial environment without enclosing the high pressure cold spray system within a spray booth, cabinet, and helium and/or nitrogen shrouds to achieve the high particle velocity and prevent oxidation of the particles, which increases manufacturing complexity and cost. High pressure cold spray processes generate particle velocity in the range of 550 m/s to 900 m/s requiring environmental containment.

One solution to some of these drawbacks of high pressure cold spraying technology is to reduce pressure of the cold spray nozzle to a speed of about 300 m/s to 500 m/s or a low pressure cold spray. However, low pressure cold spraying coatings provide an undesirable structure that does not perform well when compared with high pressure cold spray coatings. This is believed to be a result of insufficient particle velocity not providing desired particle deformation and resulting in weaker particle bonds and undesirable porosity of the resulting coating.

Therefore, it would be desirable to provide a low pressure cold spray process that provides desired particle deformation, particle bonding, and coating porosity.

SUMMARY

A method of applying a coating to a substrate includes a nozzle element for applying powder material to the substrate. The powder material is sprayed from a nozzle element onto the substrate generating a coating of powder material defined by a first film thickness and a first particle size and shape of the powder material. A deformation nozzle element is provided for spraying shot onto the coating applied to the substrate. The deformation nozzle sprays shot toward the coating of powder material disposed on the substrate to deform particles of the powder material disposed in the coating resulting in a second particle size is smaller than the first particle size and includes a second particle shape being flatter than the first particle shape. The coating is further deformed to a second film thickness that is less than the first film thickness by the spray shot directed toward the coating.

The method of the present invention enables a low pressure cold spray process be performed upon a substrate to overcome some of the manufacturing difficulties of using a high pressure coating process, while achieving performance qualities of the high pressure coating process. For the first time, a desired particle deformation and reconfiguration of crystalline structure and film build are achieved using a low pressure cold spray process. Further, the use of a deformation spray nozzle to spray shot onto the low pressure cold spray coating enhances performance characteristics beyond that of a high pressure cold spray process by the significantly improved coating structure.

BRIEF DESCRIPTION OF THE DRAWINGS

Other advantages of the present invention will be readily appreciated as the same becomes better understood by reference to the following detailed description, when considered in connection with the accompanying drawing, wherein.

DETAILED DESCRIPTION

Figure 1:
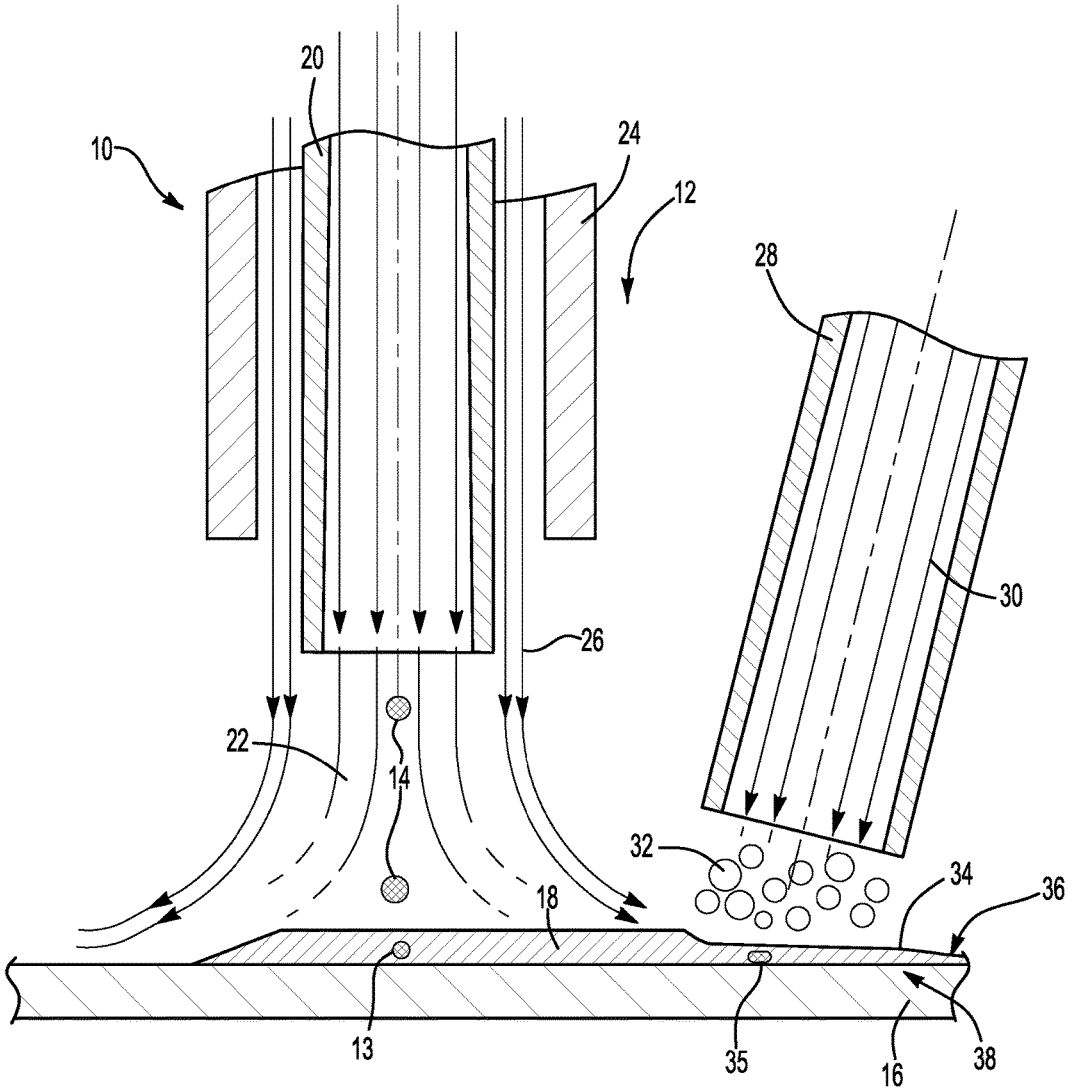
FIG. 1 shows a schematic view of the cold spray coating deposition apparatus of the present invention.

Referring to FIG. 1, a schematic of a low pressure, cold spray coating assembly is generally shown at 10. The assembly 10 includes a nozzle element 12 for applying powder material 14 to a substrate 16. For the purpose of this application, a low pressure cold spray assembly is defined as a nozzle element 12 operating at a particle velocity of between about 300 m/s to about 500 m/s, which is distinguished from a high pressure, cold spray nozzle that operates at a supersonic velocity.

The nozzle element 12 sprays the powder material 14 onto the substrate 16 forming a first coating 18 having a first film thickness and a first particle 13 grain size of the powder material 14. While the first coating thickness of the first coating 18 is tailored for desirable for performance characteristics of a particular application, the average first particle 13 grain size of the first coating 18 is believed to range between about 20 microns to 50 microns. A characteristic of the low pressure cold spray process, the average particle size is believed to not substantively decrease upon contact with the substrate 16. However, the particles disposed in the first coating 18 become slightly deformed from a substantially spherical shape to an egg shape or oval disposition.

The nozzle element 12 includes a particulate nozzle 20 that delivers a supersonic flow of delivery gas 22 into which the powder material 14 is infused. The delivery gas 22 increases the speed of the particles defining the powder material to about 300 m/s to 500 m/s with a target speed above 342 m/s or above the speed of sound.

A temperature control nozzle 24 circumscribes or substantially circumscribes the particulate nozzle 20 and provides a stream of temperature control gas 26 toward the location on the substrate 16 onto which the powder material 14 is deposited. It should be understood by those of ordinary skill in the art that the temperature control gas 26, in one embodiment is used to cool both the powder material 14 and the first coating 18. However, for other embodiments, it may be desirable to heat both the powder material 14 and the first coating 18 to achieve a desired deposition temperature. In addition, the temperature control gas 26 also helps shape a spray pattern of the powder material 14 as it is delivered from the particulate nozzle 20 toward the substrate 16.

A deformation nozzle element 28 is positioned proximate the powder nozzle element 12. The deformation nozzle element 28 emits a stream of shot gas identified by arrows 30 infused with shot 32. The shot 32 is directed toward the first coating 18 shortly after deposition onto the substrate 16. The shot 32 reshapes the first coating 18 into a second coating 34. The shot 32 reduces the grain size of the particles disposed in the first coating 18 from a range of 20 microns to 50 microns to less than about 0.1 micron average particle grain size defining a second particle 35. In addition, the film build of the first coating 18 is significantly reduced to a desired film thickness by the shot 32 in the second coating 34 the thickness of which depends upon the needs of a given application. In other words, the shot causes nano-crystallization of the first particles 13 disposed in the first coating 18 upon conversion to the second particles 35 disposed in the second coating 34.

The shot 32 results in nano-crystallization of the particles forming the coating 18/34. Nano-crystallization is more pronounced at an upper surface 36 than it is at the subsurface 38 of the second coating 34 proximate the substrate. Therefore, the second particle 35 gain size is believed to gradually decrease in the coating 34 approaching proximity to the substrate 16. Reduction in the second particle grain 35 size of the second coating 36 is also defined by impact milling, or plastic deformation, during bombardment of the first coating 18 by the shot 32. The deformation achieved in the second coating 34 by the shot 32 enhances the performance of the second coating 34 over that achievable by the first coating 18 as will be explained further herein below. The shot 32 propelled by the gas 30 travels at a velocity of between about 60 m/s to about 80 m/s. This velocity is achieved by pressure ranges of the gas of between about 5 bar to about 6 bar.

The deformation of the second coating 34 also provides an increase in density of the second coating over that of the first coating 18. In addition, the egg-shaped particles disposed in the first coating 18 are further flattened by the shot 32 increasing particle contact. The increased density and particle contact reduces the propensity of oxygen and moisture from penetrating the second coating 36 over that of the first coating 18, which is known to cause oxidation of metallic substrates. Therefore, the second coating 36 substantially seals the substrate 16 relative to the first coating 18 or a mere low pressure cold spray coating.

The shot 32 is selected from materials useful to deform the first coating 18 while not removing substantive amounts of the first coating 18 during bombardment. Therefore, the shot 32 is tailored to the material composition of the first coating 18. As such, as hardness of a particular coating is increased, a durometer of the shot 32 may also be increased to achieve the desired deformation of the first coating 18. Alternatively, softer coatings likely may make use of a softer or lower durometer shot. The shot grades included S100, S130, S170, and S280 with shot diameter including 0.03 mm, 0.04 mm, 0.5 mm and 0.8 mm. It is further contemplated that hardness of the shot is selected based upon a desired amount of nano-crystallization and deformation of the particles forming the first coating. The shot 32 is contemplated to be harder than the first coating 18 and includes a hardness value of about 50 HRC.

The shot 32 is selected from a variety of ceramic granules, or other materials including, but not limited to, $SiO_2$, SiC, $Al_2O_3$ or equivalents. In one embodiment, the shot 32 includes a size range of between 150-200 microns, which is substantially larger than the particle size of the powder material 14 disposed in the first coating 18. In one embodiment, the shot is used only once to avoid contamination of the resultant second coating 34. However, in alternative embodiments, the shot is re-used after cleaning, or when contamination of the second coating 34 is not critical.

In one embodiment, the assembly 10 achieves a fixed orientation between the powder nozzle element 12 and the deformation nozzle element 28. In this embodiment, the powder nozzle element 12 is oriented substantially perpendicular to the substrate 16, while the deformation nozzle element 28 is oriented at a fixed angle to the substrate 16 to achieve desired deformation. The angle of the deformation nozzle element 28 to the substrate 16 includes a range between about 75° to about 90° to achieve desired nano-crystallization, particle deformation and coating thickness. Alternatively, the powder nozzle element 12 and the deformation nozzle element 28 are not fixed relative to the other so that various types of deformation may be achieved on such as, for example, three-dimensional objects.

As set forth above, temperature of the first coating 18 upon deformation is controlled between a desired range. The deformation nozzle 28 also provides further control of the temperature deposition of the first coating 18 by way of temperature control of the shot gas 30. Alternatively, the deformation nozzle 28 is oriented relative to the powder nozzle 12 so that the first coating 18 achieves a desired temperature prior to deformation by the shot 32.

The invention has been described in an illustrative manner, and it is to be understood that the terminology that has been used is intended to be in a nature of words of description rather than of a limitation. Obviously, many modifications and variations of the present invention are possible in light of the above teachings. It is therefore to be understood that within the scope of the specification the referenced numerals are merely for convenience, and are not to be in any way limiting, so that the invention may be practiced otherwise therein specifically described.

What is claimed is:

1. A method of applying a coating to a substrate, comprising the steps of:

providing a nozzle element for applying powder material to a substrate;

spraying the powdered material from said nozzle element at a velocity less than the speed of sound onto the substrate thereby generating a coating of the powder material defined by a first film thickness and a first internal grain size of the particles comprising the powder material;

providing a temperature control nozzle for delivering a stream of temperature control gas to the coating circumscribing a powder spray pattern generated by said nozzle element thereby controlling a temperature and spray pattern of the coating;

providing a deformation nozzle element for spraying shot at a velocity sufficient to plastically deform the particles of powder material disposed upon the substrate;

spraying shot from the deformation nozzle toward the coating of powder material disposed upon the substrate; and plastically deforming particles of the powder material disposed in the coating forming a second internal grain size of the particles being less than the first grain size by nano-crystallizing the particles disposed in the coating following application of the powder coating onto the substrate.

2. The method set forth in claim 1, wherein said step of spraying shot toward the coating of powder material is further defined by spraying the shot at a supersonic velocity.

3. The method set forth in claim 1, wherein said step of spraying shot toward the powdered material is further defined by spraying the shot at velocity less than supersonic velocity.

4. The method set forth in claim 1, wherein said step of deforming particles of the powder material disposed in the coating is further defined by forming Nano-crystallization of the particles of powder material disposed in the coating.

5. The method set forth in claim 1, wherein said step of deforming particles of the powder material disposed in the coating is further defined by reducing average particle size from about 20 microns to 50 microns to about 0.1 microns.

6. The method set forth in claim 1, wherein said step of spraying powder material from said first nozzle element is further defined by spraying powder material at a substantially perpendicular angle to the substrate.

7. The method set forth in claim 1, wherein said step of spraying shot at the substrate toward the coating of powder material disposed upon the substrate is further defined by spraying shot at the substrate at an angle between perpendicular and zero degrees.

8. The method set forth in claim 1, wherein said step of deforming the coating to define a second film thickness being less than the first film thickness is further defined by reducing the first film thickness at least by 30% to the second film thickness.

9. The method set forth in claim 1, further including the step of providing shot having a size range between about 150 microns to 200 microns.

10. The method set forth in claim 1, further including the step of providing shot comprising ceramics consisting of $SiO_2$, SiC, $Al_2O_3$ and equivalents.

11. The method set forth in claim 1, wherein said step of deforming particles of the powder material disposed in the coating is further defined by deforming particles spaced from the substrate a greater amount than particles adjacent the substrate.

12. The method set forth in claim 1, wherein said step of generating a coating of the powder material defined by a first particle grain size is further defined by the first particle grain size including a first particle shape being substantially spherical or oval.

13. The method set forth in claim 12, wherein said step of forming a second particle grain size being smaller than the first grain particle size is further defined by forming a second particle grain size having a second particle grain shape being flatter than said first particle shape.

14. The method set forth in claim 1, wherein said step of plastically deforming particles of the powder material disposed in the coating is further defined by deforming the first grain size from a range about 20μ to 50μ to about second grain size being about 0.1μ.

* * * * *